United States Patent [19]

Yamamura et al.

[11] 4,008,657

[45] Feb. 22, 1977

[54] APPARATUS FOR ADJUSTING TEMPERATURE OF SEMIFLUID FOOD AND SUCCESSIVELY SUPPLYING THE SAME

[75] Inventors: Harukiti Yamamura, Ashiya; Takeharu Karatsu, Kobe; Yoichi Fukuhara, Nishinomiya, all of Japan

[73] Assignee: Kawatetsu Metrological Equipment and Vending Machine Company, Ltd., Nishinomiya, Japan

[22] Filed: June 2, 1975

[21] Appl. No.: 582,725

[30] Foreign Application Priority Data

July 17, 1974 Japan ..... 49-81195

[52] U.S. Cl. ..... 99/483; 99/360; 99/484; 214/305; 426/389; 426/394; 426/412

[51] Int. Cl.[2] ..... B67C 9/00

[58] Field of Search ..... 426/108, 389, 109, 113, 426/114, 115, 119, 394, 407, 408, 409, 412, 520, 521; 221/30, 31, 26, 15 A, 224, 225, 70, 71, 74; 214/305 X; 99/357, 443 R, 484, 483

[56] References Cited

UNITED STATES PATENTS

| | | | |
|---|---|---|---|
| 1,916,531 | 7/1933 | Robb | 214/305 X |
| 3,048,070 | 8/1962 | Groves | 99/357 X |
| 3,179,288 | 4/1965 | Davy | 221/30 |
| 3,260,404 | 7/1966 | Critchell | 221/30 X |
| 3,340,789 | 9/1967 | Simjian | 221/30 X |
| 3,407,948 | 10/1968 | Gutzmer | 214/305 |
| 3,487,965 | 1/1970 | Gale | 214/305 |
| 3,566,732 | 3/1971 | Hasten et al. | 221/71 |
| 3,683,729 | 8/1972 | Cloud | 221/71 X |
| 3,817,422 | 6/1974 | Raitt | 221/74 |
| 3,893,578 | 7/1975 | Melton, Jr. et al. | 214/310 X |

*Primary Examiner*—Frank W. Lutter
*Assistant Examiner*—N. Greenblum
*Attorney, Agent, or Firm*—Silverman & Cass, Ltd.

[57] ABSTRACT

A method of adjusting temperature of semifluid food and successively supplying the same is disclosed. Semifluid food is contained in a number of retort-treated packs arranged along a lengthwise direction of an elongate belt and spaced apart from each other by a given distance. The belt is preserved in a constant temperature casing at a temperature suitable for giving relish to the semifluid food and delivered from the casing at the downwardly directed generally vertical pitch every time the semifluid food is demanded. Then, while the belt is held the retort pack is cut open to permit the semifluid food to flow downwardly therefrom into a dish which is served to customers. An apparatus for carrying out the method is also disclosed, which is applicable to an automatic vending machine.

5 Claims, 13 Drawing Figures

APPARATUS FOR ADJUSTING TEMPERATURE OF SEMIFLUID FOOD AND SUCCESSIVELY SUPPLYING THE SAME

This invention relates to a method of adjusting the temperature of semifluid food and successively supplying the same and to apparatus for carrying out the method.

In the specification, the term semifluid food shall be understood to include foods seasoned beforehand with a variety of condiments or spices intended to give relish thereto such, for example, as curry for curry and rice, sauce for spaghetti, cream and the like.

Such kind of semifluid food is contained within a rectangular retort-treated pack made of two sheets of packing material with its four side edges hermetically sealed under vacuum and sterilized condition. Such a retort pack is capable of preserving the semifluid food for a long time in sanitary condition without deterioration and decay.

The retort pack is usually immersed into boiling water to heat the semifluid food. The upper edge of the retort pack is cut open and then it is turned upside down to pour the hot semifluid food to serve a person therewith.

These operations are manually carried out so that the retort pack may conveniently be used as household goods. These retort packs, however, have never been applied to an automatic vending machine provided for facilities crowded with people such as factories, stations, piers and the like.

An object of the invention is to provide a method of adjusting temperature of semifluid food and successively supplying the same, which can automatically supply the semifluid food at a temperature suitable for eating under sanitary conditions in a rapid and continuous manner.

Another object of the invention is to provide an apparatus for carrying out the above method, which is applicable to existing automatic vending machines.

A feature of the invention is the provision of a method of adjusting temperature of semifluid food and successively supplying the same, comprising preparing a belt including a number of retort packs each containing a given amount of semifluid food and arranged along a lengthwise direction of the belt and spaced apart from each other by a given distance, preserving the belt in a constant temperature casing at a temperature suitable for giving relish to the semifluid food, delivering the belt from the constant temperature casing every time the semifluid food is demanded, cutting open the upper edge of the retort pack, and pouring the semifluid food from the retort pack.

The retort pack may be cut open with the aid of a cutter such as a knife or scissors after the retort pack belt has been delivered out of the constant temperature casing. In this case, there is a risk of the cutter edge being smeared with the semifluid food. In order to avoid such difficulty, the retort pack belt may preferably be delivered in a manner such that, because of gravity, the semifluid food collects at the bottom of the retort pack and then the upper edge of the retort pack may be cut open. In addition, the retort pack with its upper edge cut opened may preferably be turned upside down to pour all of the semifluid food. Moreover, use may be made of means for holding the retort pack therebetween and extruding the semifluid food from the retort pack for the purpose of reliably discharging the semifluid food from the retort pack.

After discharge of the semifluid food from the retort pack, a vacant retort pack is discarded through a suitable chute. In this case, it is preferable to cut off and discard a tip of the upper edge of the retort pack remaining at the lower edge of a succeeding retort pack belt for sanitary purposes.

The invention will now be described in greater detail with reference to the accompanying drawings, wherein.

Figure 4:
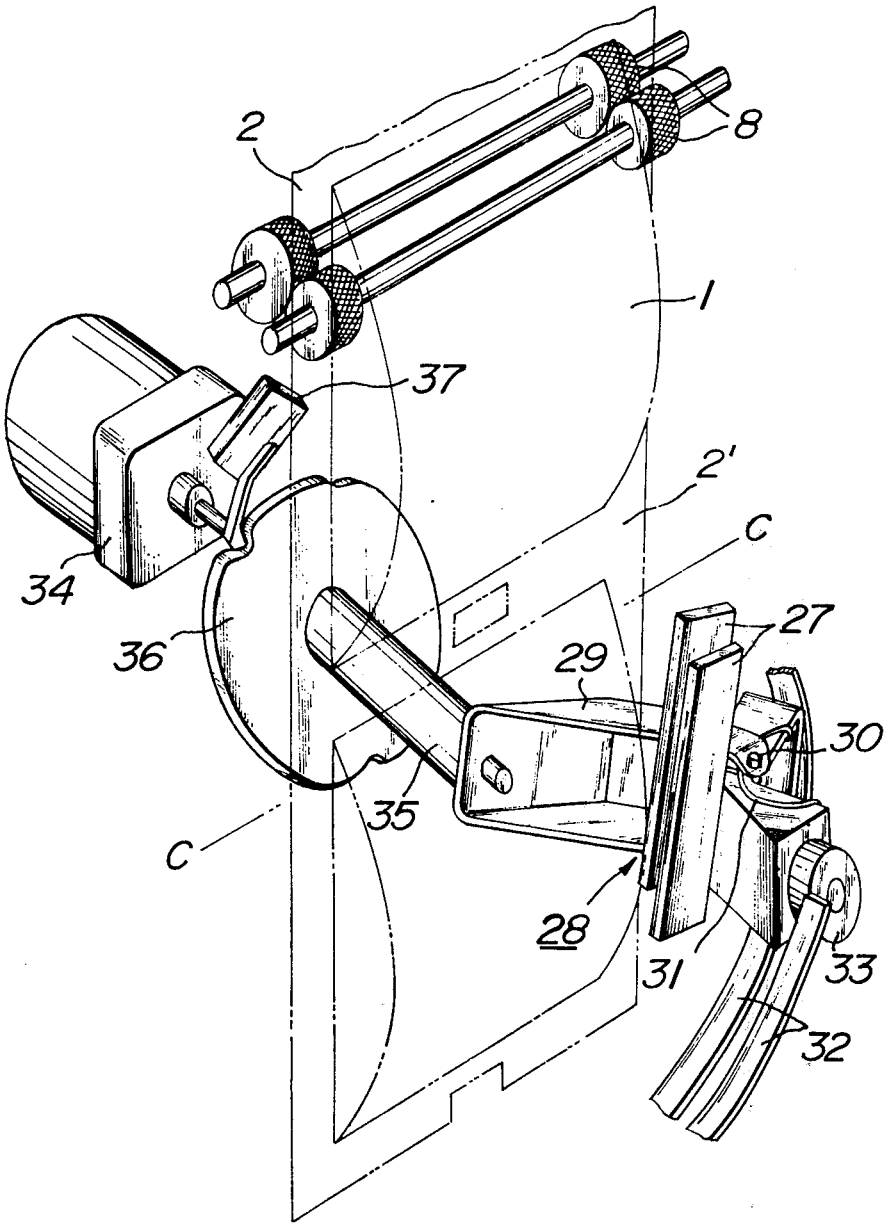
FIG. 4 is an enlarged perspective view of a rotatably mounted clamp applied to the apparatus shown in FIG. 1.
Figure 7A:
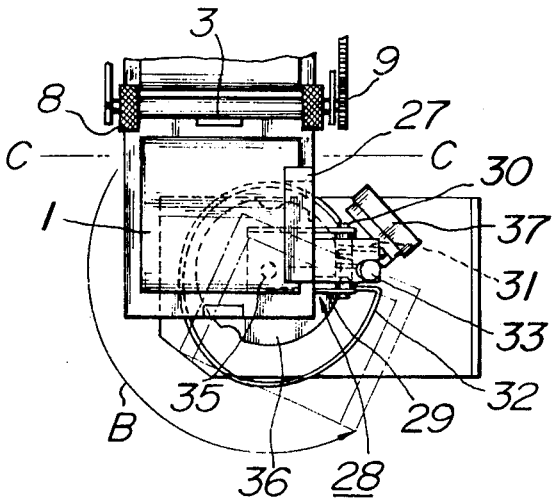
Figure 7B:
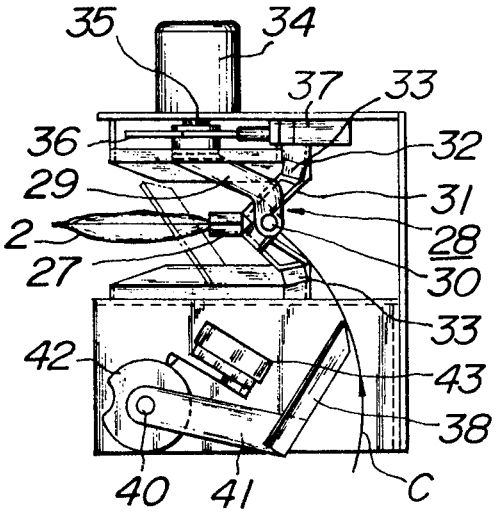
Figure 7C:
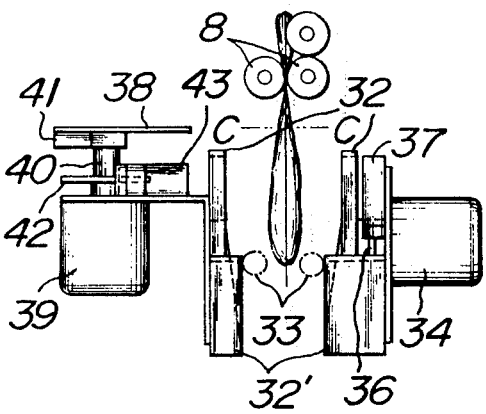
Figure 8A:
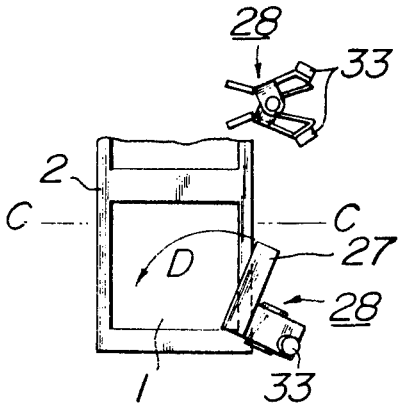
Figure 8B:
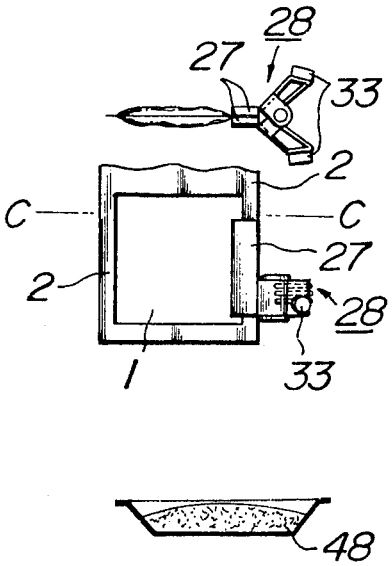
Figure 8C:
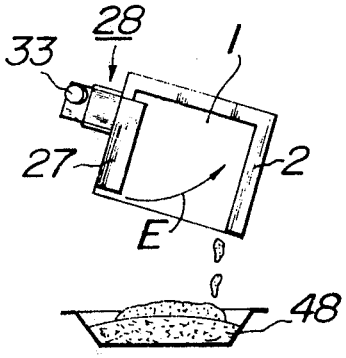
Figure 8D:
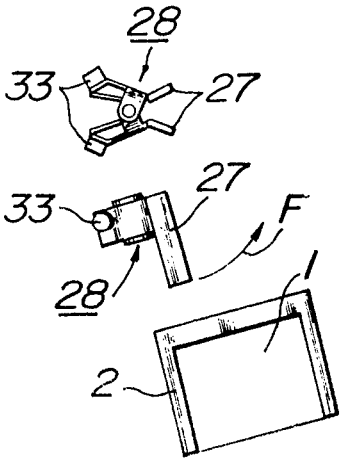

FIG. 7*a* is a front elevation of the rotatably mounted clamp shown in FIG. 4 in a reduced scale;

FIG. 7*b* is its plan view;

FIG. 7*c* is its side elevation;

FIG. 8*a* is a front elevation and plan view of the rotatably mounted clamp shown in FIG. 4 in its open condition;

FIG. 8*b* shows similarly to FIG. 8*a* a front elevation and plan view, but showing the rotatably mounted clamp in its closed condition;

FIG. 8*c* shows similarly to FIG. 8*b* a front elevation, but showing the rotatably mounted clamp in its position after it has been rotated from the position shown in FIG. 8*b* by about 150° so as to make the retort pack upside down, thereby flowing down the semifluid food into a dish; and FIG. 8*d* shows similarly to FIG. 8*c* a front elevation and plan view, but showing the rotatably mounted clamp in its open condition to discard a vacant retort pack downwardly.

Figure 1:
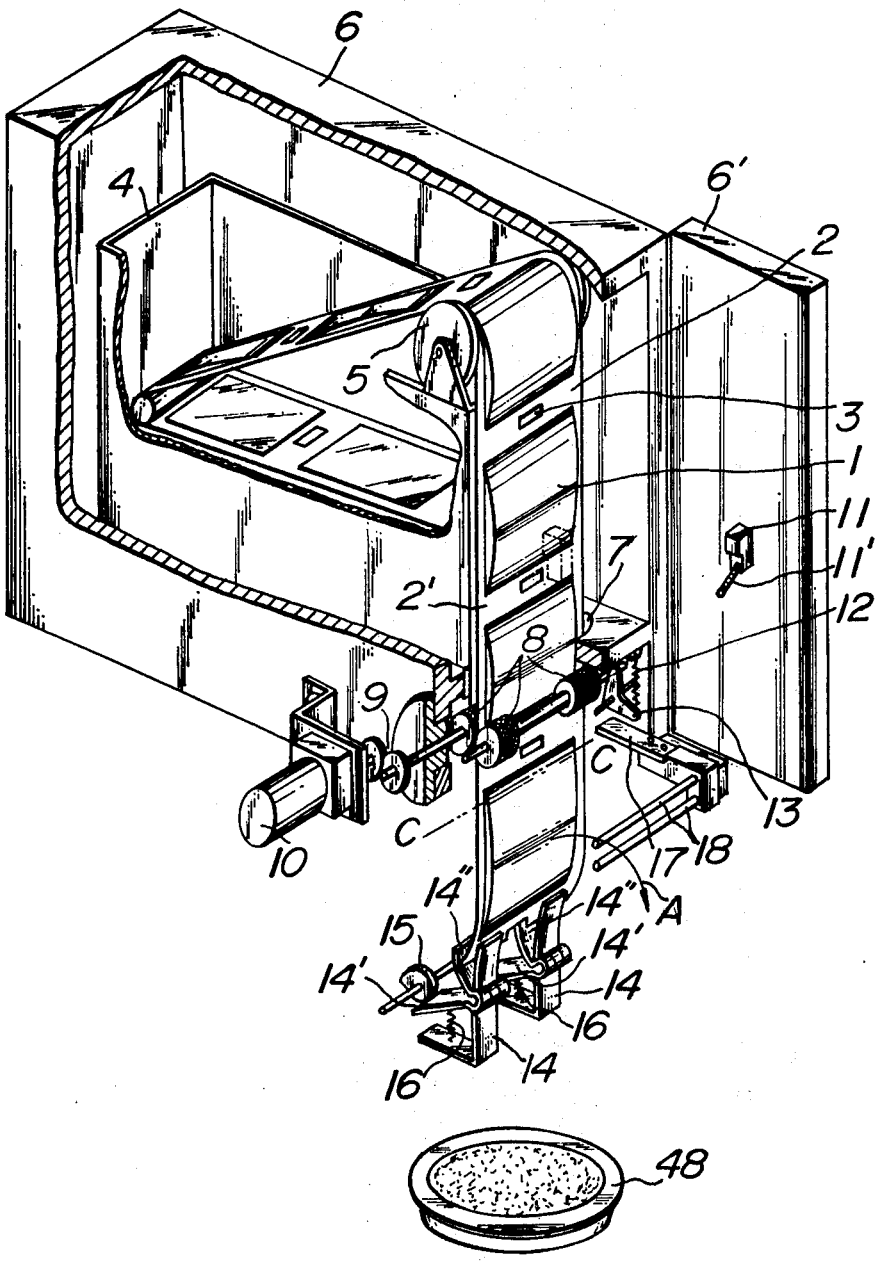
FIG. 1 is a perspective view of the apparatus partly broken away to show a retort pack belt and controls for effecting their operation in proper sequence.

Referring to FIG. 1, reference numeral 1 designates a rectangular retort pack sealed at four sides thereof and containing a given amount of semifluid food such as curry, 2 an elongate belt including a number of retort packs 1 spaced apart from each other by a given distance along the lengthwise direction of the belt 2 and 3 a control hole extended through that sealed portion 2' of the belt 2 which is intermediate between adjacent retort packs 1, 1 and for controlling the sequential supply of the retort packs 1.

The retort pack belt 2 is composed of two belt-shaped packing sheets and semifluid food is sandwiched in a rectangular space formed therebetween and hermetically sealed along four side edges of this space under vacuum sterilized condition.

The retort pack belt 2 thus prepared is delivered to and preserved in an automatic vending machine to which is applied the present invention.

It is preferable to preserve the retort pack belt 2 at a temperature on the order of 70° to 80° C which gives relish to, for example, curry. In this case, the retort pack belt 2 is folded. A forward end of the retort pack belt 2 is guided through a roller 5 vertically downwardly in front of the heating tank 4. The heating tank 4 is provided, for example, with an electric heater (not shown) and surrounded by an adiabatic layer of a constant temperature casing 6.

The constant temperature casing 6 is provided at its open front end with a hinged door 6' and at its base with a delivery opening 7 through which is extended the lower end of the retort pack belt 2. Provision is made of a pair of pinch rollers 8, 8 arranged at each side edge of the retort pack belt 2 so as to hold and guide it therebetween. Reference numeral 9 designates transmission gears and 10 designates a motor for driving the pinch rollers 8, 8 through the gears 9, thereby downwardly supplying the retort pack belt 2.

The hinged door 6' is provided at its inner surface with a normally closed microswitch 11 having an arm 11' which serves to open the microswitch 11 when it is dropped into the control hole 3, thereby deenergizing and stopping the driving motor 10 and hence the supply of the retort pack belt 2.

One of the pinch rollers 8 is urged through one side edge of the retort pack belt 2 against the other pinch roller 8 by means of one arm of a bell crank 13 another arm of which is biased by a tension spring 12.

Provision is made of a pair of clamps 14, 14 each arranged at each side of the lower end of the retort pack belt 2 and composed of one stationary support 14 and two rotatably mounted jaws 14', 14'' biased by a compression spring 16 to urge one of the jaws 14'' through the retort pack belt 2 against the stationary support 14. Another jaw 14' is always engaged with an eccentric cam 15 whose large diameter portion serves to rotate the jaws 14', 14'' against the action of the spring 16 so as to separate the jaw 14'' from the lower end of the retort pack belt 2, thereby releasing the lower end of the retort pack belt 2.

After the lower end of the retort pack belt 2 has been firmly held between the jaw 14'' and the support 14, a cutter 17 is slidably displaced along guide bars 18 to cut open the upper edge of the retort pack belt 2 on a line C—C traced by the cutter 17.

The upper edge of the stationary support 14 is inclined downwardly as shown in FIG. 1 for easily turning downwardly the upper cut open end of the retort pack 2 in a direction shown by an arrow A so as to flow down the semifluid food contained in the retort pack 2 into a dish 48 disposed directly below the clamps 14.

Then, the large diameter portion of the eccentric cam 15 becomes engaged with the rotatable jaw 14' to separate the movable jaw 14'' from the stationary support 14 to discard the vacant retort pack 1 through a suitable chute (not shown) into a reservoir (not shown). Then, a restarting switch (not shown) is closed to reenergize the motor 10 and displace the retort pack belt 2 by a small distance. Subsequently, the cutter 17 is operated to cut off a tip remained at the lower end of a next succeeding retort pack 1 along the line C—C.

Figure 2:
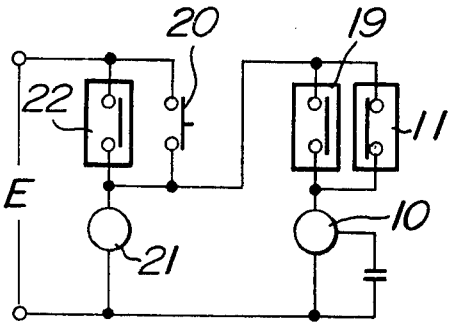
FIG. 2 is a simplified illustration of an electrical circuit that may be employed to control the apparatus shown in FIG. 1.

In FIG. 2 is shown an electrical circuit that may be employed to practice the above mentioned two cutting operations of the cutter 17 effected during supply of the retort pack belt 2.

As shown in FIG. 2, provision is made for a restarting switch 19 connected in parallel with the microswitch 11 for controlling the driving motor 10. This parallel circuit including the restarting switch 19 and the microswitch 11 is connected through a push button 20 and the driving motor 10 across an electric supply source E. In addition, a timing motor 21 is connected through a parallel circuit including the push button 20 and a self-holding switch 22 across the electric supply source E.

Figure 3:
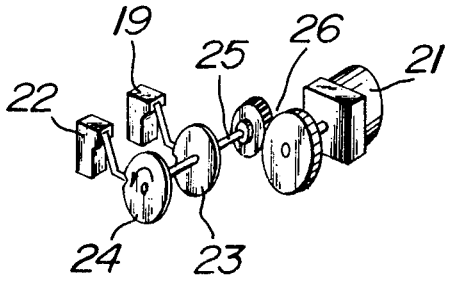
FIG. 3 is a perspective view of timing cams driven by a timing motor and controlling a self-holding switch and restarting switch shown in FIG. 2.

In FIG. 3 is shown a timing cam shaft 25 that may be employed to control the restarting switch 19 and the self-holding switch 22. These switches 19, 22 are arranged side by side and operatively connected to cams 23, 24, secured to the cam shaft 25, respectively. The cam shaft 25 is connected through a pair of gears 26 to the timing motor 21.

If the push button switch 20 is closed, the motor 10 is energized through the normally closed microswitch 11 to deliver the retort pack belt 2 as described above. At the same time, the timing motor 21 is directly energized to rotate the cam shaft 25 and hence the cam 24 causes the normally open self-holding switch 22 to close. The cam 24 is designed to open the self-holding switch 22 after one rotation of the cam 24.

If the arm 11' of the microswitch 11 is dropped into the control hole 3 of the retort pack belt 2, the normally closed microswitch 11 becomes open to deenergize the motor 10, and as a result, the motor 10 is stopped. Then, the cutter 17 is displaced along the line C—C to cut open the upper end of the retort pack 1. Subsequently, the retort pack 1 is turned downwardly in the direction shown by the arrow A in FIG. 1 to discharge the semifluid food out of the retort pack 1. The continuous rotation of the cam shaft 25 ensures a closure of the normally open restarting switch 19 by means of the cam 23. As a result, the motor 10 is reenergized to displace the retort pack belt 2 by a short distance so as to align the intermediate sealed portion 2' with the line C—C. Then, the cam 24 completes its one rotation to open the self-holding switch 22, thereby deenergizing and stopping both the motors 10 and 21. Subsequently, the cutter 17 operates again to cut out the tip remaining at the lower end of the succeeding retort pack belt 2 on the line C—C. Then, the circuit shown in FIG. 2 and the timing shaft 25 shown in FIG. 3 are ready for the next operation cycle to be effected by closing the normally open push button 20.

In FIG. 4 is shown a rotatable clamp 28 which can reliably discharge the semifluid food from the cut open end of the retort pack 1.

A clamp 28 shown in FIG. 4 comprises a pair of jaws 27 for firmly holding together one side edge of the vertically hanging down retort pack belt 2. The clamp 28 is secured through a shaft 30 to a rotary bracket 29. The jaws 27 are closed by a spring 31 inserted between rear arms of these jaws 27 which are provided at their ends with rollers 33, 33. These rollers 33, 33 are guided along two stationary annular face cams 32, 32 separated from each other and each provided at its lower half region with projected portion 32', 32' as shown in FIGS. 7*a* and 7*c*.

The rotary bracket 29 is rotated about the shaft 35 to turn the clamp 28 in a direction shown by an arrow B in FIG. 7*a* until a cam 36 secured to the shaft 35 causes a microswitch 37 to open and deenergize a clamp motor 34.

In FIGS. 7*b* and 7*c* is shown another embodiment of the cutter by reference numeral 38. The cutter 38 is mounted on an outer end of a rotary arm 41 whose inner end is secured to a shaft 40 of a cutter motor 39. To the shaft 40 is secured a cam 42 that serves to open a microswitch 43 and hence deenergize and stop the cutter motor 39 after one rotation of the cutter 38.

Figure 5:
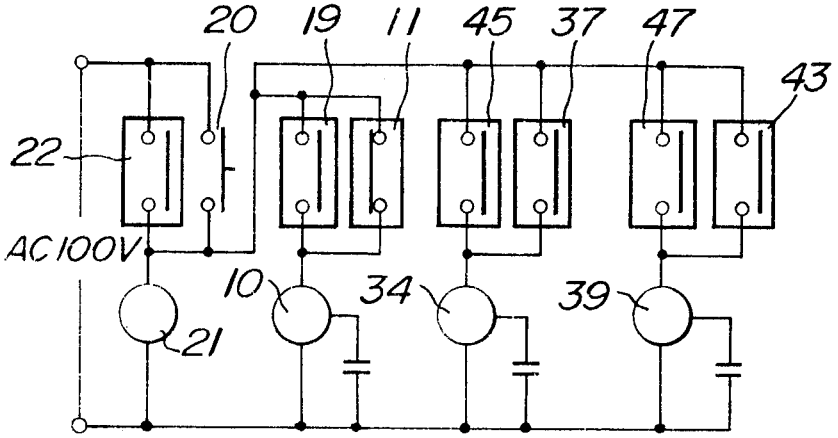
FIG. 5 is a simplified illustration of an electrical circuit that may be employed to control the apparatus shown in FIG. 4.
Figure 6:
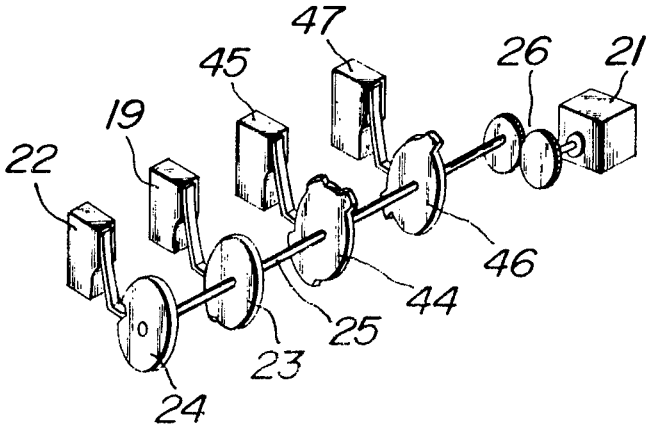
FIG. 6 is a perspective view of timing cams driven by the timing motor and controlling the self-holding switch and restarting switch as well as controlling a clamp switch and cutter switch shown in FIG. 5.

As in the embodiment shown in FIGS. 1, 2 and 3, if the push button 20 shown in FIG. 5 is closed, both the driving motor 10 and the timing motor 21 are energized to supply the retort pack belt 2 and at the same time rotate the timing shaft 25. As a result, the cam 24 causes the normally open self-holding switch 22 to close, thereby maintaining the rotation of the timing shaft 25 irrespective of opening of the push button switch 20. The rotation of the motor 10 ensures supply of the retort pack belt 2 through the pinch rollers 8, 8. The rotation of the cam shaft 25 causes the cam 44 to rotate and close the normally open clamp switch 45 and energize the clamp motor 34. The clamp motor 34 is started to rotate the bracket 29 around the shaft 35. As a result, the clamp 28 is rotated in a direction shown by an arrow D in FIG. 8*a* toward one side edge of the retort pack belt 2. As soon as the retort pack belt 2 has been moved a given distance, the rollers 33, 33 become disengaged from the projected portion 32', 32' of the stationary face cams 32, 32, respectively, to hold the one side edge of the retort pack belt 2 between the jaws 27 by means of the spring 31 as shown in FIG. 8*b*. In the meantime, the cam 36 causes the microswitch 37 to open and deenergize the clamp motor 34 for a while, thereby stopping the rotary arm 29 and the clamp 28. The continuous rotation of the cam shaft 25 ensures a closure of the cutter switch 47 by the cam 46, and as a result, the cutter motor 39 is energized and rotated to cut open the upper edge of the retort pack 1 along the line C—C. After one rotation of the cutter 38, the microswitch 43 becomes opened to deenergize and stop the cutter motor 39. The cutter 38 is now ready for its next cutting operation.

A continuous rotation of the cam shaft 25 causes the cam 44 to close the clamp switch 45 again to reenergize and rotate the clamp motor 34 to rotate the clamp 28 together with the cut open retort pack 1 held between the jaws 27 from a position shown in FIG. 8*b* to a position shown in FIG. 8*c* over an angle of about 150°. As a result, the cut open end of the retort pack 1 becomes upside down as shown in FIG. 8*c* to permit the semifluid food to flow down from the retort pack 1 into the dish 48 located immediately below a vertical outer cover of the apparatus as shown in FIG. 8*c*.

In this case, provision may eventually be made of means pressed on each surface of the retort pack 1 so as to extrude the semifluid food therefrom.

During the discharge of the semifluid food, the cam 36 causes the microswitch 37 to open to deenergize and stop the rotation of the rotary bracket 29. After the lapse of time required for discharging the semifluid food, the cam 44 causes the clamp switch 45 to close, thereby energizing and rotating the clamp motor 34. As a result, the clamp 28 is rotated from a position shown in FIG. 8*d* to the position shown in FIG. 4 in a direction shown by an arrow F in FIG. 8*d*.

During such rotation of the clamp 28, its rollers 33 arrive at the flat portions of the cams 32, respectively, to open the jaws 27 to discard the vacant retort pack 1 into the chute as shown in FIG. 8*d*.

In the meantime, the continuous rotation of the cam shaft 25 causes the restarting switch 19 to be closed by the cam 23, whereby the motor 10 is restarted to move the retort pack belt 2 downwardly until the sealed portion 2' of the lower end of the succeeding retort pack belt 2 is aligned with the cutting position C—C. At the same time, the continuous rotation of the cam shaft 25 causes the cutter switch 47 to be closed by the cam 46 again, whereby the cutter motor 39 is restarted to rotate the cutter 38 again in the direction shown by the arrow C in FIG. 7*b*, whereby the intermediate sealed portion 2' is cut off, thereby discarding the tip remained at the lower end of the next succeeding retort belt 2.

It is preferable to discard the tip when the vacant retort pack 1 is discarded from the clamp 28 as shown in FIG. 8*d*.

The above mentioned one cycle of the operation of the apparatus according to the invention is completed when the self-holding switch 22 becomes open by the cam 24 to stop the timing motor 21. Then, the apparatus is ready for the next operation which will be started when the push button switch 20 is closed again. Thus, if the push button switch 20 is made in response to insertion of a coin into a slit of an automatic vending machine, the retort pack 1 can be cut open and the semifluid food can be supplied at a suitable temperature which is desirable to customers in an automatic and continuous manner.

As stated hereinbefore, the invention is capable of continuously and successively supplying semifluid food at a suitable temperature which is desirable to customers at any time when demanded and hence is beneficially applicable to an automatic vending machine provided for factories, waiting rooms and the like. In addition, the invention is capable of cutting open the heated retort packs on demand so that the semifluid food can be served under sanitaty conditions.

What is claimed is:

1. An apparatus for adjusting the temperature of semifluid food and successively supplying the same, comprising a constant temperature casing including an outer cover enclosing said casing and having a delivery opening, said casing capable of preserving a belt including a number of retort packs each containing a given amount of semifluid food at a temperature suitable for giving relish to said semifluid food, said retort packs being arranged along the length of the belt spaced inward of the edges thereof and spaced apart one from the other by a given distance, means for feeding said belt from said constant temperature casing and directing said belt in a downwardly generally vertical direction toward the delivery opening incrementally every time said semifluid food is demanded, cutter means arranged directly below the constant temperature casing in the vicinity of the delivery opening and capable of severing the belt along the upper edge portion of a retort pack, means for clamping one edge of the belt at least during the operation of said cutter means and including means for turning said opened retort pack upside down to permit gravity flow of the contents thereof, said clamping means operable to release the emptied retort pack.

2. The apparatus as claimed in claim 1 in which there are control means operable on said feed means to advance the belt incrementally to a condition where an intermediate belt portion located between the severed retort pack and the next succeeding retort pack is positioned at said cutter means at a time subsequent to delivery of said food from the opened retort pack and said cutter means being operable to sever said intermediate belt portion from the belt.

3. The apparatus as claimed in claim 1 in which the outer cover also encloses said feed means, and said casing is secured within said cover.

4. The apparatus as claimed in claim 1 in which said means for clamping comprises a rotatable clamp arranged to engage a side portion of the belt adjacent said retort pack that is to be opened and said means for turning said opened retort pack includes means for rotating said clamp with the opened pack clamped therein to position said retort pack about 150° from the position it assumes during the operation of said cutter means.

5. The apparatus as claimed in claim 1 in which said clamping means includes a cam-operated clamp capable of engaging the belt immediately below the retort pack to be opened and capable of operating subsequent to severance of the upper edge thereof to flip the opened pack upside down for delivery of the food from the opened edge portion thereof.

* * * * *